US005541818A

United States Patent [19]

Ng et al.

[11] Patent Number: 5,541,818

[45] Date of Patent: Jul. 30, 1996

[54] MINIATURE LIGHT MOUNTING ARRANGEMENT

[75] Inventors: Samuel Ng; David A. Parshad, both of Ontario, Canada

[73] Assignee: Noma, Inc., Toronto, Canada

[21] Appl. No.: 386,937

[22] Filed: Feb. 10, 1995

[51] Int. Cl.[6] ..... F21P 1/02

[52] U.S. Cl. ..... 362/123; 362/249; 362/396

[58] Field of Search ..... 362/123, 191, 362/249, 250, 396, 806

[56] References Cited

U.S. PATENT DOCUMENTS

| | | | |
|---|---|---|---|
| 3,584,795 | 6/1971 | Baird | 362/396 |
| 5,249,108 | 9/1993 | Gary | 362/396 X |
| 5,446,640 | 8/1995 | Lin | 362/249 X |

*Primary Examiner*—Stephen F. Husar
*Attorney, Agent, or Firm*—Kirschstein, et al.

[57] ABSTRACT

An arrangement for mounting a miniature light on a tree branch includes a mounting member that has a first end portion forming a first channel for receiving a portion of the miniature light, and a bifurcated second end portion forming a recess for receiving a portion of a respective branch that is situated at the location at which the miniature light is to be placed. The recess has at least two portions respectively bounded by at least two substantially circularly cylindrical surfaces of different diameter. The recess portions open into one another at respective cusps separating the recess portions from one another. The cylindrical surface diameters decrease from one of the recess portions to another in a direction toward the one end portion and are so chosen as to enable the respective recess portions to individually accommodate and frictionally engage the branch portion having thicknesses within a wide range.

7 Claims, 2 Drawing Sheets

MINIATURE LIGHT MOUNTING ARRANGEMENT

BACKGROUND OF THE INVENTION

1. Field of the Invention

The present invention relates to mounting arrangements in general, and more particularly to arrangements for mounting miniature lights on tree branches, particularly those of a Christmas tree, or on similar substantially cylindrical supports.

2. Description of the Related Art

Various constructions of arrangements for attaching lights to the branches of a Christmas tree have been known from time immemorial, ever since candles have been used to illuminate such trees. Of course, back then it was indispensable to employ such attaching or holding arrangements and to construct them in such a manner as to safely hold the candles in their upright positions to minimize dripping of the molten wax and reduce the danger of setting the tree on fire to a minimum. Consequently, such a candle holding arrangement was quite an elaborate affair, typically including, besides a spring-loaded tong-action clasping device, a holder for the bottom portion of the candle and a dish-shaped formation surrounding the holder and serving to capture molten wax that may have found its way into it after flowing on the exterior of the candle and that of the holder.

With the advent of the use of miniature electrical lights instead of candles for such and similar illumination purposes, the need for holding the lights in their upright or erect positions became less pronounced; obviously, no wax drips from the miniature lights and the amount of heat generated by each of them during normal operation is so minuscule that there is no danger of setting the tree on fire even if their glass envelopes or bulbs are in contact with the tree foliage or branches for an extended period of time. In view of this, miniature light sets are often merely placed from above on the respective branches, and their light bulbs are allowed to hang down or extend in whichever direction they may assume by chance.

While the impression given by the miniature lights under these circumstances may be acceptable to many, to others it detracts from the festivity of the occasion by evoking a certain degree of disorderliness and failing to project an aesthetic appeal reminiscent of that of real candles. In view of this, there has been developed at least one type of a mounting arrangement for miniature lights.

This known arrangement includes a holder for the miniature light that is constructed as a split sleeve including two shell portions joined with one another at the bottom and separated from each other at diagonally opposite locations by two vertical slots, with all directions mentioned herein being as considered in the position in which the mounting arrangement is used to attach the miniature light in its erect position to the respective branch. When the miniature light (actually, its socket) is inserted into the sleeve, the wires connecting the miniature light with the other lights of the light set and/or with the plug pass through the aforementioned slots. The inner diameter of the split sleeve may be slightly smaller than the outer diameter of the miniature light socket so that the latter is received in the sleeve with a slight interference fit caused by the elastically yieldable shell portions being pushed apart. This measure prevents the miniature light from accidentally falling out or even being inadvertently pushed or pulled out of the split sleeve.

The bottom portion of the split sleeve is provided with two generally strip-shaped integral projections extending along a common plane and spaced from each other in that plane by a distance at least slightly smaller than the anticipated diameter of the branch on which the miniature light is to be mounted. However, since it is recognized that the branch diameters on even artificial trees, and even more on real trees, differ from one another to a considerable degree either from branch to branch or along the same branch, and coupled with the realization that the person decorating or trimming the tree is often not able to freely choose the branch section of an acceptable diameter for mounting the light on, it was proposed to include in a set of such mounting arrangements a number of such arrangements having a smaller distance between the plate-shaped projections, and another number of such arrangements exhibiting a larger such distance for mounting on thicker branches.

Of course, this solution leaves much to be desired in that it frequently requires the user to remove the previously chosen mounting arrangement already installed on the miniature light socket and replace it with a different one after having noticed that at the location chosen for that particular miniature light the branch is either too thick or too thin for using such previously chosen mounting arrangement thereon.

OBJECTS OF THE INVENTION

Accordingly, it is a general object of the present invention to avoid the disadvantages of the prior art.

More particularly, it is an object of the present invention to provide an arrangement for mounting a miniature light on a Christmas tree or the like, which arrangement does not possess the drawbacks of the known arrangements of this type.

Still another object of the present invention is to devise a mounting arrangement of the type here under consideration which is universal in the sense of being engageable with a branch of almost any diameter that can be found on the tree to be decorated.

It is yet another object of the present invention to design the above arrangement in such a manner as to be operative to securely hold the miniature light in its erect position irrespective of the diameter of the branch on which this arrangement is supported.

A concomitant object of the present invention is so to construct the arrangement of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an arrangement for mounting a miniature light on a tree branch. The mounting arrangement includes a mounting member having a first end portion forming a first channel for receiving a portion of the miniature light, and a bifurcated second end portion forming a recess for receiving a portion of a respective branch that is situated at the location at which the miniature light is to be placed.

According to the invention, the recess has at least two portions respectively bounded by at least two substantially circularly cylindrical surfaces of different diameter. The recess portions open into one another at respective cusps separating the recess portions from one another, and also open onto an end face of the second end portion. Tapered edges are located at the end face. The aforementioned diameters decrease from one of the recess portions to another in the direction toward the one end portion, and are so chosen that the recess portions are able to individually accommodate and frictionally engage the branch portion having thicknesses within a wide range.

Advantageously, the cusps are rounded to facilitate the passage of the respective branch portion between them.

According to another advantageous facet of the present invention, the bifurcated second end portion of the mounting member includes two arms bounding the aforementioned recess, and the mounting member is of an elastically yieldable material that permits the arms to move apart and together as the branch portion passes between at least one of the cusps and the tapered edges and to frictionally engage the branch portion once lodged in the appropriate one of the recess portions.

As for the first end portion, it may be bifurcated and have resilient arms bounding the first channel. Alternatively, the first end portion may have a slotted, box-like construction for receiving the light portion.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
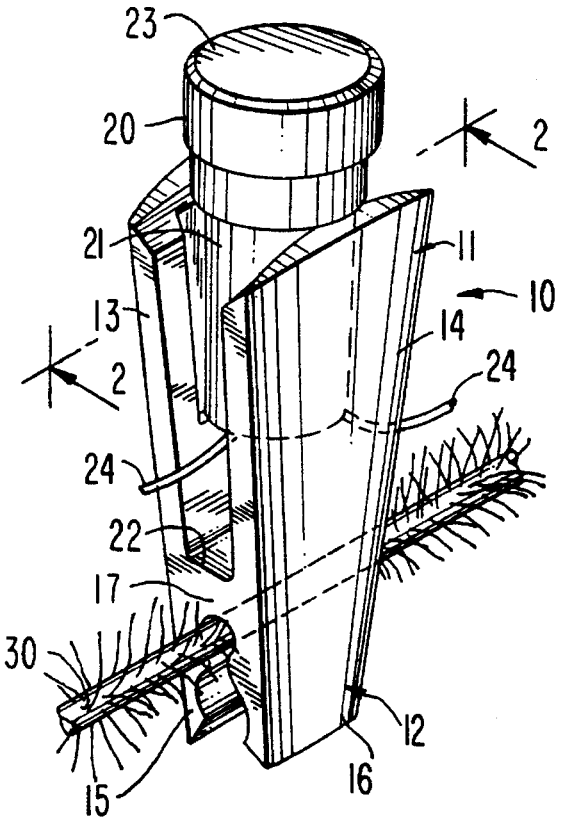
FIG. 1 is a perspective view of one embodiment of the mounting arrangement of the present invention as used to support a miniature light in its erect position on a Christmas tree branch of a relatively small diameter.

Referring now to the drawing in detail, and first to FIG. 1 thereof, it may be seen that the reference numeral 10 has been used therein to identify one embodiment of a miniature light mounting arrangement of the present invention in its entirety. As its name implies, the miniature light mounting arrangement 10 is designed for mounting a miniature light 20 constituting a member of a miniature light set or chain on a support 30. In the situation contemplated here, the support 30 to which the mounting arrangement 10 is to be attached takes the form of a Christmas tree branch as illustrated, or a similar cylindrical object.

Figure 2:
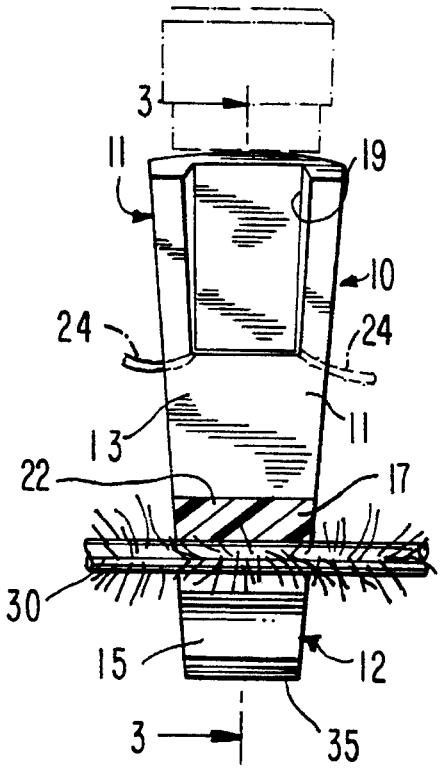
FIG. 2 is a cross-sectional view of the mounting arrangement taken on line 2—2 of FIG. 1.

As a comparison of FIGS. 1 and 2 of the drawing will reveal, the mounting arrangement 10 has an upper portion 11 that is preferably, but not necessarily, bifurcated, and a lower portion 12 that is bifurcated. At this juncture, it is to be mentioned that, when reference is being had to directions such as up or down, upper or lower, or left or right, such reference relates solely to the orientation shown in FIGS. 1 to 3 of the drawing and has no other significance whatsoever. As a matter of fact, a user may decide to let any or all of the set of miniature lights 20 and their associated mounting arrangements 10 pend down from the respective branches 30, rather than extend upwardly thereof in an erect position thereof as shown, in which case the "upper" portion 11 of the mounting arrangement 10 would actually be situated below the "lower" portion 12. The bifurcated upper and lower portions 11 and 12, that is their respective arms 13 and 14, or 15 and 16, respectively, are connected with one another by a transverse yoke portion 17. As shown particularly in FIGS. 2 and 3 of the drawing, the arms 13 and 14 have respective recesses 18 and 19.

The mounting arrangement or member 10 is made of a material, especially a synthetic plastic material, that is resilient to a certain degree. A variety of materials is already known and in widespread use for these and similar purposes, so that it is not deemed necessary to enumerate them all. Suffice it to say that a material commercially available under the designation ABS is a particularly viable candidate for making the mounting member 10 therefrom. Because of this elastic yieldability or resiliency, the upper arms 13 and 14 will yield slightly in the transverse direction as the light 20, and more particularly a socket part 21 thereof, is pushed from above into a channel 22 bounded by the arms 13 and 14 and the yoke portion 17, provided that the transverse dimension of the channel 22, inclusive of the recesses 18 and 19, exceeds that of the miniature light socket part 21, as contemplated. As a matter of fact, the channel 22 and the socket part 21 are so configured that the extent to which the arms 13 and 14 are pushed apart increases with increasing degree of penetration of the socket part 21 into the channel 22. 0f course, the miniature light 20 also includes a lamp part 23 that is mounted on the socket part 21, and insulated electric wires indicated at 24 extend through and past the arms 13, 14 and connect the individual miniature light 20 with other lights of the same set and/or with the electric plug thereof.

Figure 3:
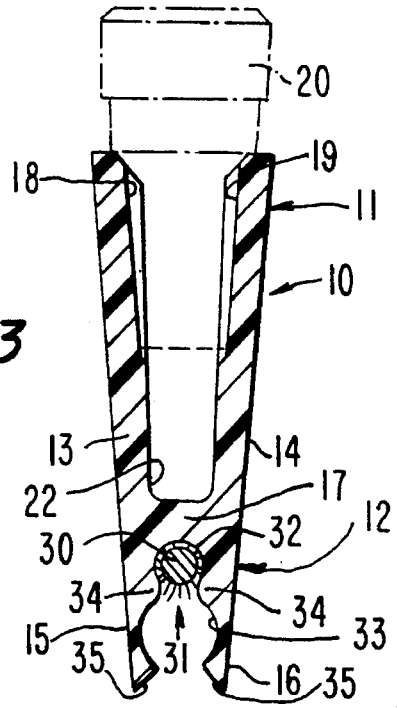
FIG. 3 is another sectional view of the mounting arrangement but taken on line 3—3 of FIG. 2.
Figure 4:
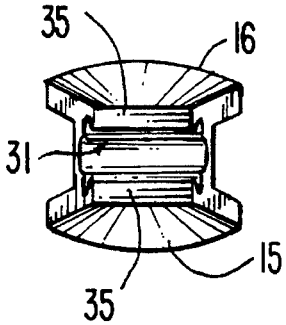
FIG. 4 is a bottom plan view of the mounting arrangement of the present invention in its inoperative state.

As mentioned before, the diameter of the branch 30 to which the mounting arrangement 10 is to be secured at the particular location at which the light 20 is to be placed may fall anywhere within a relatively wide range of such branch diameters. In fact, the branch diameter varies widely from branch to branch as well as along the very same branch. To be able to mount the light 20 on that branch 30 that passes through or by the chosen location, regardless of the diameter of such branch 30 so long as such diameter is within the aforementioned range, the bifurcated lower portion 12 of the mounting member 10 is provided, as clearly visible especially in FIG. 3 of the drawing, with a recess 31 the cross section of which generally resembles the numeral eight in that it has a smaller head portion 32 and a larger base portion 33. The head and base portions 32 and 33 are bounded by respective arcuate surfaces of the lower arms 15 and 16 and merge with one another at, and are separated from each other by, respective rounded cusps 34. Moreover, the base portion 33 is delimited at its lower end as seen in FIG. 3 by respective rounded tapered edges 35. The arcuate surfaces bounding the head and base portions 32 and 33 are preferably configured as parts of at least substantially circular cylinders.

When the branch 30 to which the miniature light 20 is to be attached has a relatively small diameter at the location chosen for the placement of such light 20, the mounting arrangement 10 is pressed onto it with such a force and for so long as needed for the affected portion of the branch 30 to bypass not only the tapered edges 35 (which it may be able to do without even touching them, because of its relatively small size) but also the cusps 34. This is the situation depicted in FIGS. 1 to 3 of the drawing.

Of course, there is a lower threshold of the thickness of the branch portion on which the mounting arrangement 10 can be mounted when it is desired for the light 20 to assume and remain in its illustrated upright or erect position, this lower limit corresponding to a diameter substantially equal to that of the arcuate surface bounding the head portion 32 of the recess 31.

On the other hand, somewhat thicker branch portions may also be, and often are, introduced into the head portion 32. Generally speaking, the diameters of the branch portions lie between the aforementioned lower threshold and an upper threshold of the head portion 32 that may correspond to, or even be somewhat above, a lower threshold of the larger base portion 33 of the recess 31.

As in the case of the head portion 32, the aforementioned branch thickness lower limit or threshold for the base portion 33 lies in the vicinity of the diameter of the arcuate surface bounding the base portion 33 of the recess 31. In both instances, the upper limit is well below the level at which the pushing of the arms 15 and 16 apart as it is attempted to force the respective branch portion past the rounded cusps 34 or the tapered edges 35 would result in a plastic deformation or other structural deformation of the arms 15 and 16.

Figure 5:
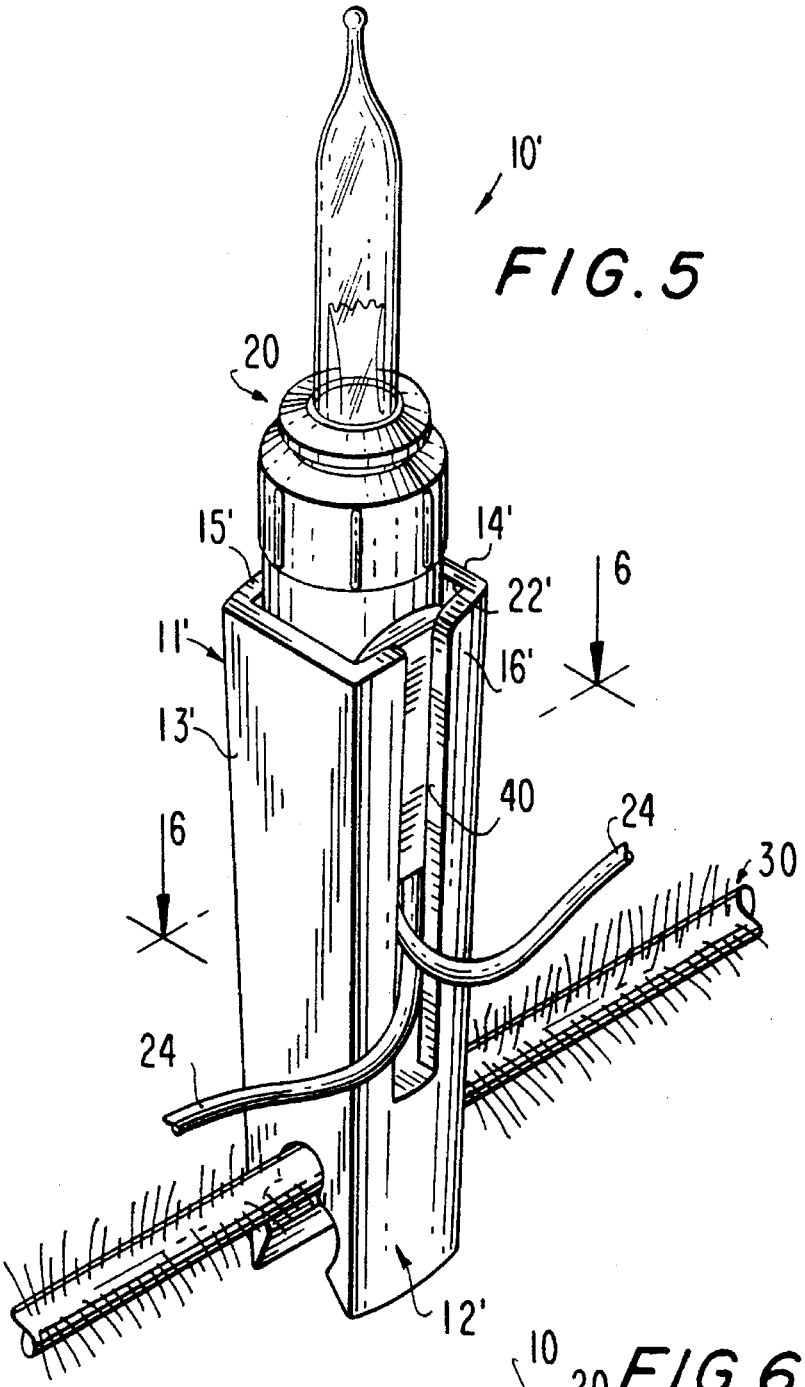
FIG. 5 is a perspective view of another embodiment of the mounting arrangement of the present invention.
Figure 6:
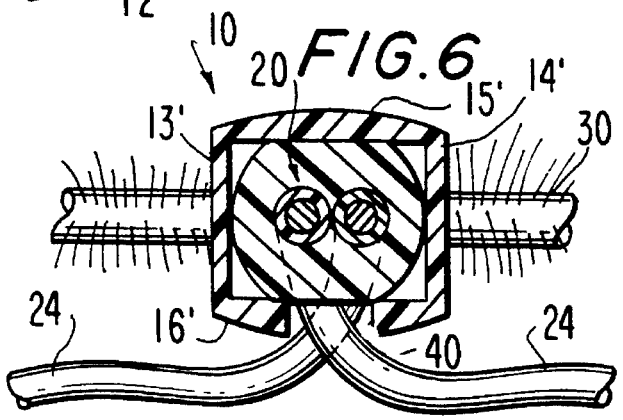
FIG. 6 is a cross-sectional view of the mounting arrangement of FIG. 5 taken on line 6—6 of FIG. 5.

Referring now to FIGS. 5 and 6, reference numeral 10' identifies another embodiment of a light mounting arrangement essentially identical to the arrangement 10, except for the construction of the upper portion and the manner in which the wires 24 are routed therefrom.

Rather than being bifurcated, the upper portion 11' has a plurality of walls 13', 14', 15' and 16' bounding a first box-like channel 22'. Walls 13' and 14' are planar to each other. Walls 15' and 16' are slightly concavely curved. Wall 16' is centrally slit along an upright slot 40 that communicates with the channel 22'. The slot 40 opens as the light 20 is inserted. Both wires 24 are routed through the common slot 40.

It will be understood that each of the elements described above, or two or more together, may also find a useful application in other types of constructions differing from the type described above.

While the present invention has been described and illustrated herein as embodied in specific constructions of an arrangement for mounting a miniature light on a tree branch of a thickness within a wide range, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An arrangement for mounting a miniature light on a generally cylindrical support, comprising:

a mounting member having a first end portion forming a first channel for receiving a portion of the miniature light, and a bifurcated second end portion forming a recess for receiving a portion of a respective support that is situated at the location at which the miniature light is to be placed, said recess having at least two portions respectively bounded by at least two substantially circularly cylindrical surfaces of different diameter, said recess portions opening into one another at respective cusps separating said recess portions from one another, said recess portions opening onto an end face of said second end portion, and said diameters decreasing from one of said recess portions to another in a direction toward said one end portion and being so chosen that said recess portions are able to individually accommodate and frictionally engage the support portion having thicknesses within a wide range.

2. The arrangement as defined in claim 1, wherein said cusps are rounded to facilitate the passage of said support portion between said cusps.

3. The arrangement as defined in claim 1, wherein said end face has tapered edges to facilitate the passage of said support between said tapered edges.

4. The arrangement as defined in claim 1, wherein said bifurcated second end portion of said mounting member includes two arms bounding said recess; and wherein said mounting member is of an elastically yieldable material that permits said arms to move apart and together as said support portion passes between said cusps and to frictionally engage said support portion once lodged in the appropriate one of said recess porions.

5. The arrangement as defined in claim 1, wherein said first end portion is bifurcated has a pair of arms spaced transversely apart to bound channels through which electrical wires connected to the light extend.

6. The arrangement as defined in claim 1, wherein said first end portion has walls bounding said first channel, one of said walls having a channel through which electrical wires connected to the light extend.

7. The arrangement as defined in claim 1, wherein the support is a tree branch.

* * * * *